US008749446B2

(12) United States Patent
Manry, Jr. et al.

(10) Patent No.: US 8,749,446 B2
(45) Date of Patent: Jun. 10, 2014

(54) WIDE-BAND LINKED-RING ANTENNA ELEMENT FOR PHASED ARRAYS

(75) Inventors: Charles W. Manry, Jr., Auburn, WA (US); Lixin Cai, Ravensdale, WA (US)

(73) Assignee: The Boeing Company, Chicago, IL (US)

( * ) Notice: Subject to any disclaimer, the term of this patent is extended or adjusted under 35 U.S.C. 154(b) by 375 days.

(21) Appl. No.: 13/194,344

(22) Filed: Jul. 29, 2011

(65) Prior Publication Data

US 2013/0028298 A1 Jan. 31, 2013

(51) Int. Cl.
*H01Q 7/00* (2006.01)

(52) U.S. Cl.
USPC ..... 343/866; 343/700 MS; 343/841

(58) Field of Classification Search
USPC ..... 343/700 MS, 841, 866, 867
See application file for complete search history.

(56) References Cited

U.S. PATENT DOCUMENTS

| | | | | |
|---|---|---|---|---|
| 5,539,420 | A * | 7/1996 | Dusseux et al. | 343/769 |
| 7,863,728 | B2 | 1/2011 | Beer et al. | |
| 8,502,684 | B2 * | 8/2013 | Bunza et al. | 340/573.5 |
| 2004/0183735 | A1 | 9/2004 | Jecko | |
| 2004/0217907 | A1 * | 11/2004 | Inoue | 343/728 |
| 2007/0052587 | A1 | 3/2007 | Cheng | |
| 2012/0026066 | A1 * | 2/2012 | Leisten | 343/895 |

OTHER PUBLICATIONS

Masayuki, Nakano et al., "Feed Circuits of Double-Layered Self-Diplexing Antenna for Mobile Satellite Communications," IEEE Transactions on Antennas and Propogation, IEEE Service Center, Piscataway, NJ, US., vol. 40, No. 10, Oct. 1, 1992, pp. 1269-1271.

European Search Report dated Nov. 15, 2012 in EP Application No. 12176798.2-2220.

Chen, Jin-Sen, "Dual-Frequency Annular-Ring Slot Antennas Fed by CPW Feed and Microstrip Line Feed," IEEE Transactions APS, vol. 53, No. 1, Jan. 2005, pp. 569-571.

Ren, Yu-Jiun, "An Ultrawideband Micrstrip Dual-Ring Antenna for Millimeter-Wave Applications," IEEE Antennas & Wireless Propagation Letters, vol. 6, 2007, pp. 457-459.

Das, A. et al., "Radiation Characteristics of Higher-Order Modes in Microstrip Ring Antenna," IEEE Proceedings, vol. 131, Pt H, No. 2, Apr. 1984, pp. 102-103.

Chew, Weng Cho, "A Broad-Band Annual-Ring Microstrip Antenna," IEEE Transactions APS, vol. Ap-30, No. 5, Sep. 1982, Sec. I, pp. 918-919, Sec. V, pp. 920-921.

Bahl, I.J. et al., "A New Microstrip Radiation for Medical Applications," IEEE Transactions on Microwave Theory and Techniques, vol. MTT-28, No. 12, Dec. 1980, pp. 1464-1468.

U.S. Appl. No. 13/052,034, filed Mar. 18, 2011 and entitled "Multi-Band Antenna Element with Integral Faraday Cage for Phased Arrays".

* cited by examiner

*Primary Examiner* — Tan Ho
(74) *Attorney, Agent, or Firm* — Hope Baldauff, LLC

(57) ABSTRACT

Technologies for a wide-band linked-ring antenna element covering two adjacent K-band military and/or commercial receive bands are provided. The antenna element comprises a linked-ring conductive resonator that is electromagnetically coupled to at least one feed line. The conductive resonator and feed line are further surrounded by a Faraday cage that is conductively coupled to an electromagnetically-shielding ground plane and operable to shield the conductive resonator and the feed line.

24 Claims, 5 Drawing Sheets

WIDE-BAND LINKED-RING ANTENNA ELEMENT FOR PHASED ARRAYS

BACKGROUND

Typical microwave and millimeter-wave frequency directive antennas generally comprise cumbersome structures such as waveguides, dish antennas, helical coils, horns, and other large non-conformal structures. Communication applications where at least one communicator is moving as well as radar applications generally require a steerable beam and/or steerable reception. Phased array antennas are particularly useful for beam-steered applications since beam-steering can be accomplished electronically without physical motion of the antenna. Such electronic beam steering can be faster and more accurate and reliable than gimbaled/motor-driven mechanical antenna steering. Phased array antennas also provide a capability to have multiple simultaneous signal beams.

In addition, communications in multiple bands typically require either multiple antenna apertures for each of the bands and/or dual band dish antennas. On-aircraft dishes are generally placed under radomes, adding significantly to the weight of the aircraft, aerodynamic drag, and maintenance complication. A single wide-band phased array aperture minimizes vehicle integration cost and size, weight, and power needs compared to multiple single-band solutions and/or dish antennas. However, conventional low-profile designs using slot rings and/or microstrip patch antennas suffer from mutual coupling that limit their frequency coverage, scan volume, and axial ratio performance.

It is with respect to these and other considerations that the disclosure made herein is presented.

SUMMARY

It should be appreciated that this Summary is provided to introduce a selection of concepts in a simplified form that are further described below in the Detailed Description. This Summary is not intended to be used to limit the scope of the claimed subject matter.

A wide-band linked-ring antenna element is described herein for implementing a single, conformal phased array for satellite communications ("SATCOM") that covers both the 17.7-20.2 GHz commercial and 20.2-21.2 GHz military SATCOM receive K-bands. An array of the antenna elements provides a wide scan volume better than 60 degrees of conical scan volume from boresight and maintains good circular polarization axial ratio over the specified frequency bands, while being very thin and lightweight. The antenna element may also be scaled to other frequency bands, used as a transmitting element, and used for other phased array antenna applications, such as line-of-sight communication links, signal intelligent ("SIGINT") arrays, radars, sensor arrays, and the like.

According to one aspect, an antenna element comprises a linked-ring conductive resonator that is electromagnetically coupled to at least one feed line. The conductive resonator and feed line are further surrounded by a Faraday cage that is conductively coupled to an electromagnetically-shielding ground plane and operable to shield the conductive resonator and the feed line.

The features, functions, and advantages discussed herein can be achieved independently in various embodiments of the present disclosure or may be combined in yet other embodiments, further details of which can be seen with reference to the following description and drawings.

DETAILED DESCRIPTION

The following detailed description is directed to a wide-band, linked-ring antenna element for phased arrays. Utilizing the antenna element described herein, a single, conformal phased array may be implemented for SATCOM receive covering the adjacent military and commercial receive bands. The antenna element provides a wide scan volume better than 60 degrees of conical scan volume from boresight and maintains good circular polarization axial ratio over the specified frequency bands. The antenna element design is light weight and very thin. It also does not require a wide angle impedance matching ("WAIM") layer or radome, thus greatly reducing aerodynamic drag of an aircraft as well as integration and maintenance costs. The antenna elements may also be scaled to other frequency bands and phased array antenna applications, used as transmitting elements, and used for other phased array applications, such as line-of-sight communication links, signal intelligence ("SIGINT") arrays, radars, sensor arrays, and the like.

Embodiments of the disclosure are described herein in the context of a planar or conformal SATCOM phased array antenna. Embodiments of the disclosure, however, are not limited to such planar SATCOM applications, and the techniques described herein may also be utilized in other applications. For example, embodiments may be applicable to conformal antennas, manned and unmanned aircraft antennas, line-of-sight communications, sensor antennas, radar antennas, and the like.

In the following detailed description, references are made to the accompanying drawings that form a part hereof, and that show, by way of illustration, specific embodiments or examples. The drawings herein are not drawn to scale. Like numerals represent like elements throughout the several figures.

Figure 1:
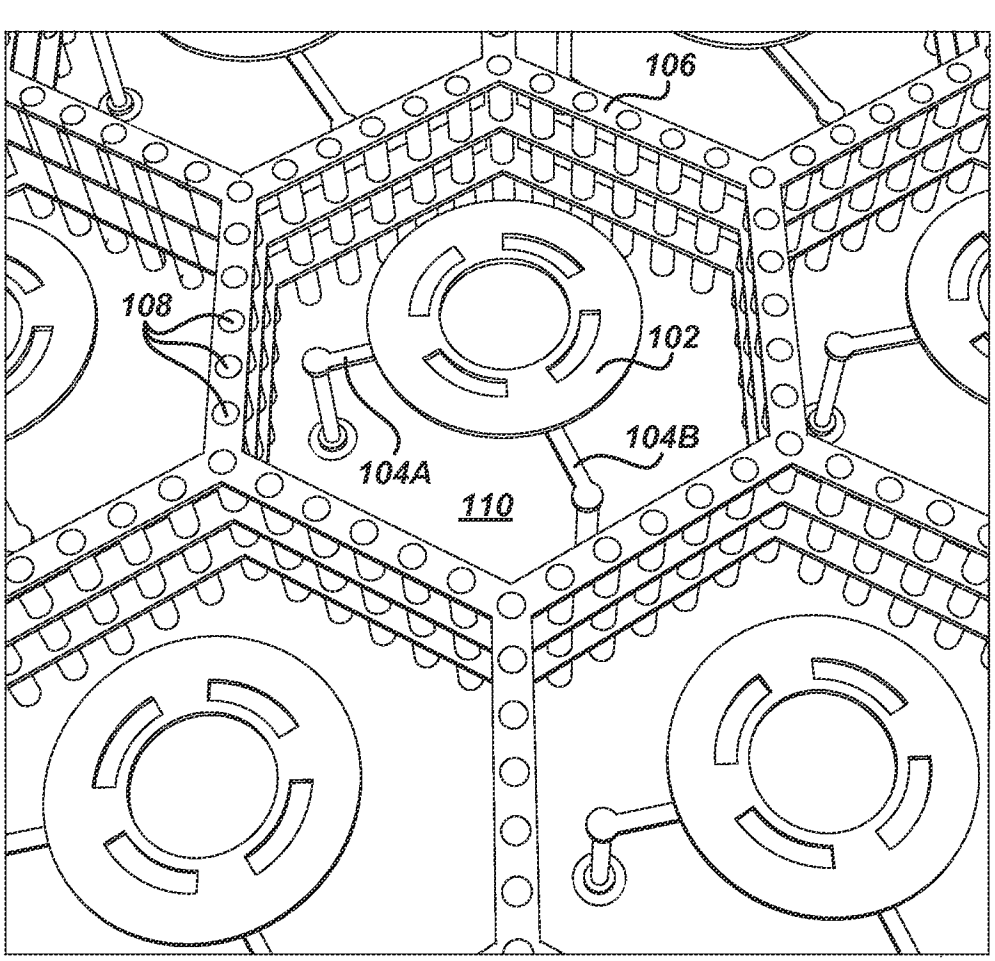
FIG. 1 is a perspective view an antenna element implemented in an array, according to embodiments presented herein.

FIG. 1 shows a perspective view of an antenna element 100 implemented in a conformal phased array for SATCOM applications, according to embodiments described herein. The antenna element 100 includes a single, linked-ring conductive resonator 102 electromechanically coupled to two feed lines 104A and 104B, all surrounded by a Faraday cage 106. The antenna element 100 may be implemented in multilayer circuit board comprising two, three, four, or more layers. It will be appreciated that FIG. 1 shows the elements implemented on the various layers of the multi-layer circuit board, but does not show a substrate or dielectric between layers.

The conductive resonator 102 is implemented on the top, surface layer and is operable to resonate at electromagnetic frequencies to be received. According to embodiments, the conductive resonator comprises multiple ring elements that are linked by tuning tabs, as will be described in more detail below in regard to FIG. 3. The conductive resonator may be implemented on the surface layer using metallization, microstrips, direct-write, and the like.

The feed lines 104A, 104B (referred to herein generally as feed lines 104) are implemented on the second layer below the conductive resonator 102 and are electromagnetically coupled to the conductive resonator to drive the conductive resonator for transmit and/or receive a signal from the conductive resonator. According, to one embodiment, the feed lines 104A and 104B are implemented on the second layer using microstrip traces. It will be appreciated that the feed lines 104 may also be implemented using metallization, direct-write, and the like. The electromagnetic coupling may comprise inductive coupling, a capacitive coupling, and the like.

The Faraday cage 106 is operable to shield the conductive resonator 102 and the feed lines 104. The Faraday cage 106 comprises an electromagnetically-shielding ground plane 110 implemented on the lowest layer, a plurality of conductive vias 108 electromagnetically coupled to the ground plane 110 and rising through the layers of the multi-layer circuit board to the top layer, and a conductive strip implemented on each layer directly and electromagnetically coupling the vias 108 and the surrounding the conductive strips 106. The conductive strips may be implemented on the respective layers using metallization, microstrips, direct-write, and the like. According to one embodiment, the conductive vias 108 comprise holes drilled through the layers of the multi-layer circuit board and filled or plated with copper or other conductive material.

The conductive strips and conductive vias 108 may be arranged in a hexagonal shape surrounding the conductive resonator 102 and the feed lines 104, as shown in FIG. 1, so as to form an electrically conductive cage operable to isolate/shield the conductive resonator 102 and feed lines 104 of the antenna element 100 from bottom and side external electrical fields, such as those generated by a neighboring antenna element in an array, external antennas of neighboring devices, and the like. It will be appreciated that the conductive strips and conductive vias 108 may be arranged in any other polygonal shape that facilitates the implementation of the antenna element 100 in an array, including, but not limited to, a triangle, a square, a rectangle, a hexagon, and octagon, and the like. In a further embodiment, the Faraday cage 106 is implemented as described in co-pending U.S. patent application Ser. No. 13/052,034, filed on Mar. 18, 2011 and entitled "Multi-Band Antenna Element with Integral Faraday Cage for Phased Arrays," which is incorporated herein by this reference in its entirety.

Figure 2:
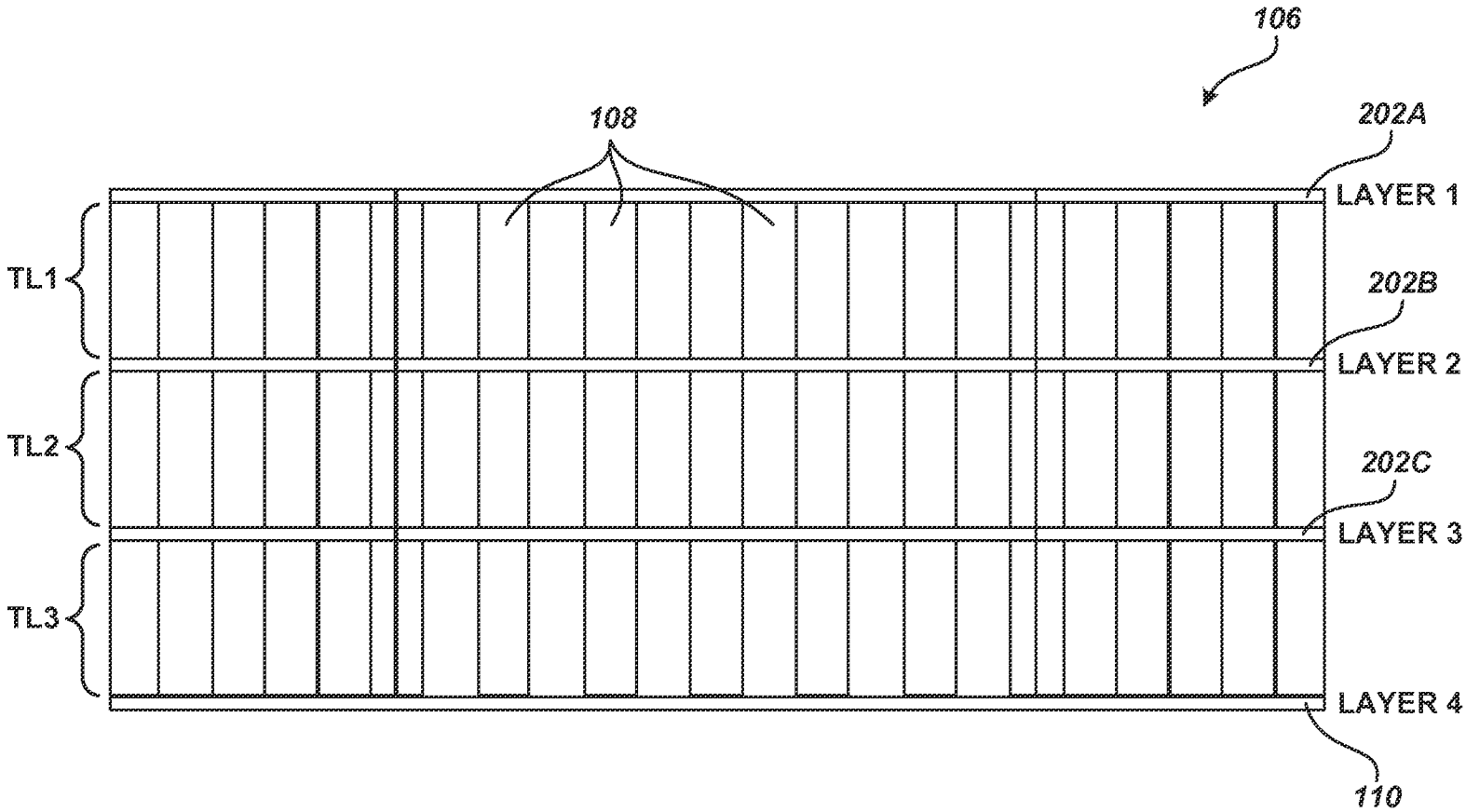
FIG. 2 is a side view of a Faraday cage surrounding the transmission components of the antenna element, according to embodiments presented herein.

FIG. 2 shows a side view of the Faraday cage 106 surrounding the conductive resonator 102 and feed lines 104 of the antenna element 100 and implemented in four layers, according to one embodiment. As described above, the Faraday cage 106 may comprise an electromagnetically-shielding ground plane 110 on the lowest layer, or layer 4 as shown in the figure. Conductive strips 202A, 202B, 202C (referred to herein generally as conductive strips 202) may be implemented on each of the upper layers of the multi-layer circuit board, or layer 1, layer 2, and layer 3 respectively, as further shown in FIG. 2. The conductive vias 108 may pass from the top layer, i.e. layer 1, through the intervening layers, i.e. layer 2 and layer 3, and to the bottom ground plane 110 implemented on the bottom layer, i.e. layer 4, of the multi-layer circuit board.

The substrate or dielectric between the layers of the multi-layer circuit board may be constructed of a low-loss, low-dielectric-constant circuit board material, such as RT/DUROID® 5870/5880 boards from Rogers Corporation of Chandler, Ariz. It will be appreciated that the multi-layer circuit board may be constructed from any suitable low-loss low-dielectric-constant material. According to one embodiment, the thickness of the dielectric between the first two layers, labeled TL1, may be about 20 mils, and the thickness between the remaining layers, labeled TL2 and TL3, may be about 31 mils. Not shown in the figures are adhesive layers between layers 1, 2, and 3. It will be appreciated that the number of layers implemented, the method to adhere the layers together, and the thicknesses TL1, TL2, and TL3 of the dielectric between the layers in the antenna element 100 may be varied to provide the desired overall thickness of the conformal array, and to implement a Faraday cage 106 that is capable of minimizing coupling from adjacent antenna elements and allow the antenna element to scan down to 60 degrees or better from boresight. In addition, the number, size, and spacing of the conductive vias 108 in the Faraday cage 106 may also affect the performance of the cage and the antenna element. In one embodiment, the conductive vias 108 may have a radius of about 7 mils.

Figure 3:
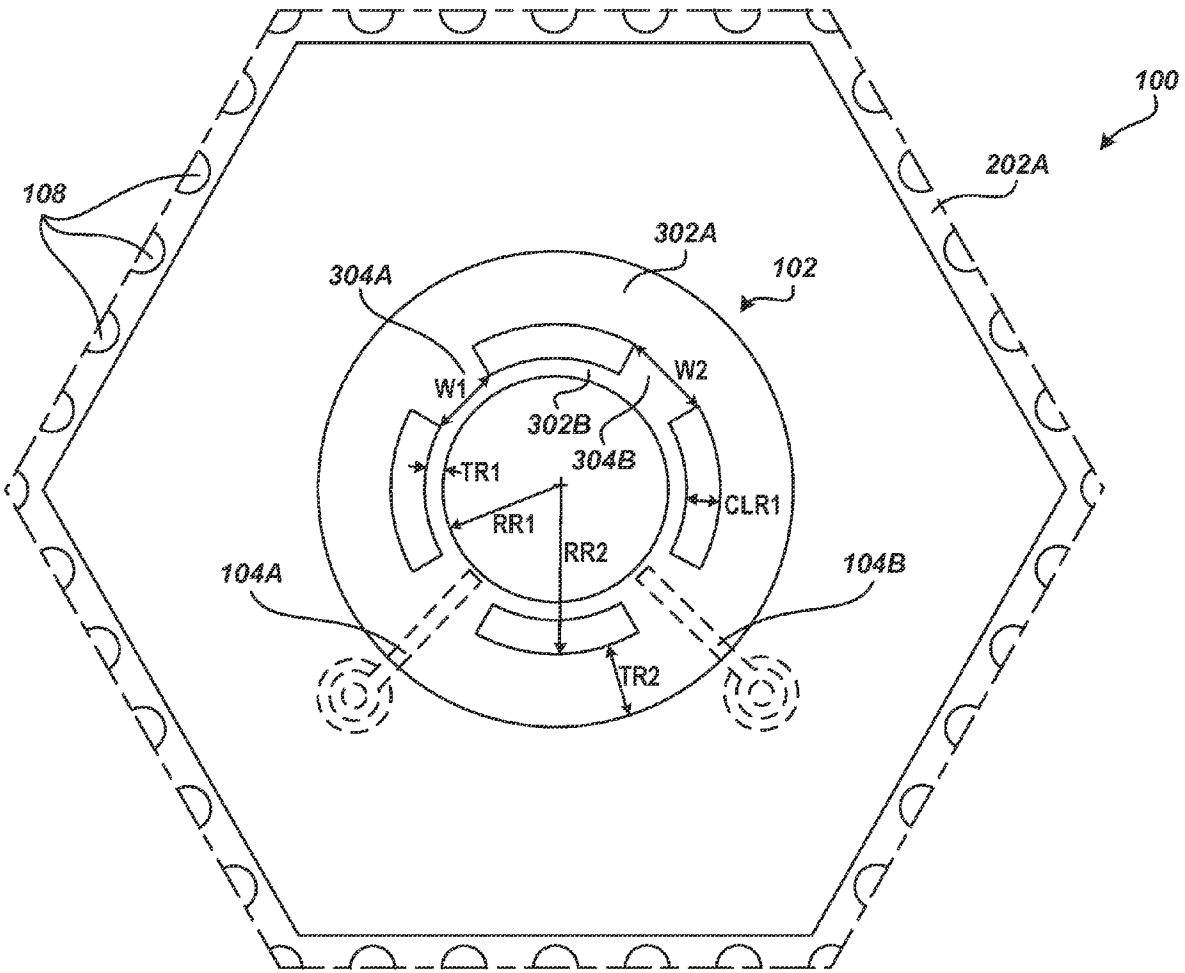
FIG. 3 is a top-down view of an exemplary linked-ring conductive resonator implemented on the top layer of the antenna element, according to embodiments presented herein.

FIG. 3 shows a top-down view of an exemplary linked-ring conductive resonator 102 implemented on the top layer, layer 1, of the antenna element 100. As described above, the conductive resonator 102 comprises multiple ring elements, such as ring elements 302A and 302B (referred to herein as ring elements 302), that are linked by tuning tabs, such as tuning tabs 304A and 304B (referred to herein as tuning tabs 304). According to one embodiment, the linked-ring conductive resonator 102 may comprise two ring elements, an outer ring element 302A and an inner ring element 302B, connected by four, equally spaced tuning tabs 304. The outer ring element 302A resonates the energy provided by the feed lines 104A, 104B while the structure and configuration of the inner ring element 302B and the tuning tabs 304 allows for "tuning" of the conductive resonator 102 to be operable in the desired frequency band.

In a further embodiment, the inner radius RR1 of the inner ring element 302B may be about 36.6 mils, while the inner radius RR2 of the outer ring 302A may be about 53.6 mils. The thickness TR1 of the inner ring 302B may be about 6.2 mils and the thickness TR2 of the outer ring element 302A may be about 24.8 mils, with a clearance CLR1 between the rings of about 10.8 mils. Each tuning tab 304 may have an inner width W1 of about 22.2 mils and an outer width W2 of about 27.7 mils. This structure may allow the conductive resonator 102 of the antenna element 100 to perform optimally in the 17.7-21.2 GHz adjacent commercial and military SATCOM receive bands. It will be appreciated that the number of ring elements 302 and tuning tabs 304 and their corresponding dimensions RR1, RR2, TR1, R2, W1, W2, and CLR1 may be varied in order to tune the linked-ring conductive resonator 102 for suitable operation in the desired frequency bands.

Further shown in FIG. 3 is the conductive strip 202A implemented on the top layer, layer 1, and the conductive vias 108 comprising the Faraday cage 106 of the antenna element 100. The components of the Faraday cage 106 shown in FIG. 3 are split to signify the shared nature of the Faraday cage 106 of one antenna element with its neighbors in the phased array, as shown in FIG. 1. Further, the size and configuration of the Faraday cage 106 in regard to the conductive resonator 102 and feed lines 104 may further be adjusted to provide for optimal performance of the antenna element 100 in the intended configuration and operational frequency bands.

Figure 4:
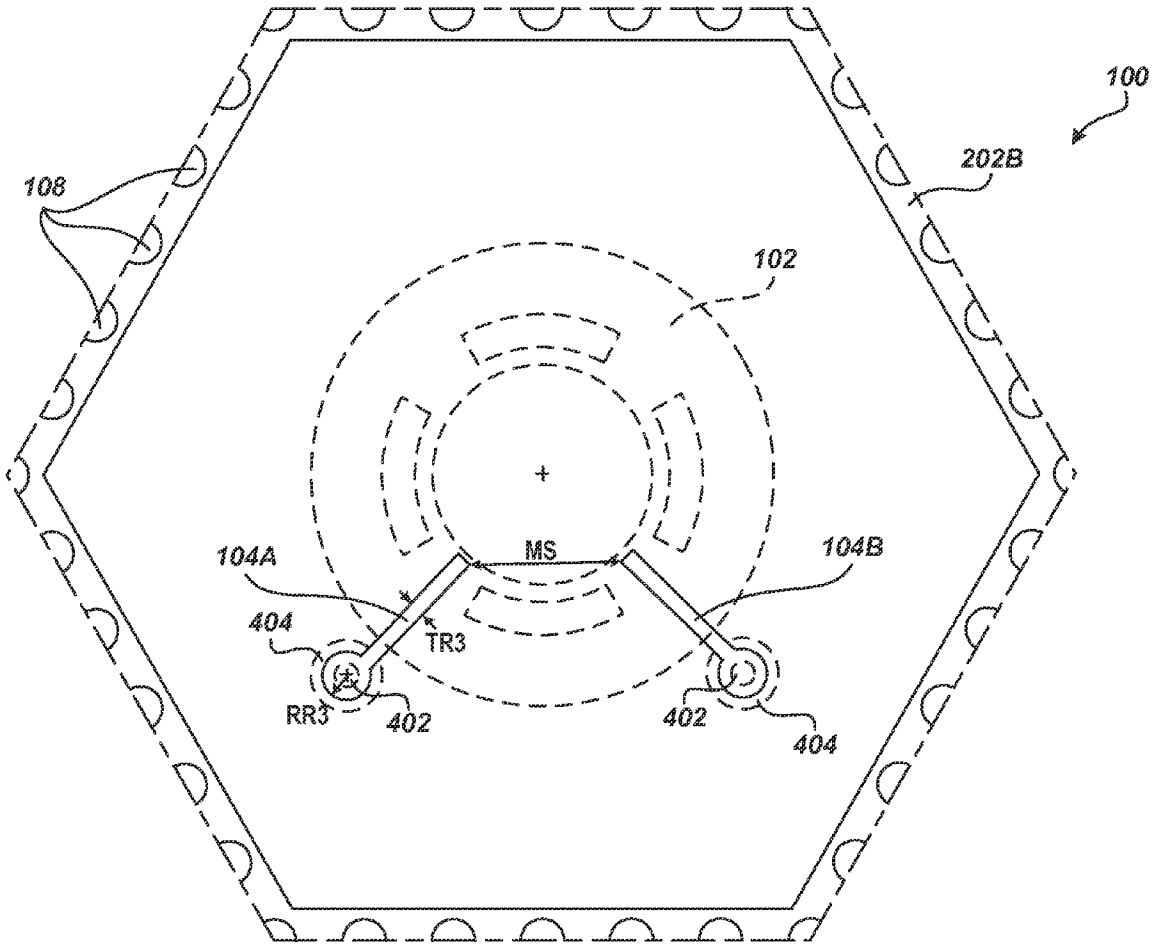
FIG. 4 is a top-down view of exemplary microstrip feed lines implemented on a layer below the conductive resonator of the antenna element 100, according to embodiments described herein.

FIG. 4 shows a top-down view of exemplary feed lines 104A and 104B implemented on the second layer, layer 2, of the antenna element 100. As described above, the antenna element may comprise two microstrip feed lines 104A and 104B installed below the linked-ring conductive resonator 102 and electromagnetically coupled to the resonator. According to one embodiment, the microstrip feed lines 104A and 104B are installed substantially at right angles to one another and capacitively coupled to the conductive resonator 102 above, as shown in FIG. 4. For example, the microstrip feed lines 104A and 104B may be oriented at 90±5 degrees in relation to one another. The right angle configuration of the feed lines 104A and 104B provides for bi-modal operation of the antenna element 100 allowing selectable right-hand circular polarized or left-hand circular polarized SATCOM signals to be received, or dual orthogonal linearly polarized signals for other applications.

The feed lines 104A and 104B may be connected to signal sources by coupling vias 402 that run from the bottom of the microstrip feed lines, through the remaining layers, layer 2 and layer 3, and to via pads (not shown) located in an aperture 404 in the ground plane 110 at the bottom layer, layer 4, of the antenna element 100. In a further embodiment, the feed lines 104A and 104B are located about 20 mils below the conductive resonator 102, and have a thickness TR3 of about 4 mils and a radius RR3 at the connection point to the coupling vias 402 of about 8 mils. The minimum separation MS between the opposite ends of the microstrip feed lines 104A and 104B may be about 12 mils. It will be appreciated that thickness TR3, board layer adhesion methods, radius RR3, the minimum separation MS, and the length and placement of the feed lines 104A and 104B may be varied to provide optimal operation of the antenna element 100 in the desired frequency bands.

The coupling vias 402 may be about 4 mils in radius and run about 62 mills through the remaining layers to the via pads in the ground plane 110. The via pads may be about 8 mils in radius, while the apertures 404 in the ground plane 110 for the via pads may have a radius of about 18.4 mils. The via pads may be further electrically coupled to communication electronics (also not shown) that provide independent signaling to and from the antenna element 100. Further shown in FIG. 4 is the conductive strip 202B implemented on the middle layer, layer 2, and the conductive vias 108 comprising the Faraday cage 106 of the antenna element 100. The components of the Faraday cage 106 shown in FIG. 4 are split to signify the shared nature of the Faraday cage 106 of one antenna element with its neighbors in the phased array, as shown in FIG. 1.

Embodiments of the antenna element 100 described herein provide for the construction of single conformal phased passive array antenna with minimal size, weight, and power ("SWAP"), as well as minimal integration cost. The SWAP is greatly reduced by elimination of multiple narrow-band "stove-piped" SATCOM banded systems and associated separate antenna installations. Embodiments further provide a phased array antenna that can cover at least two SATCOM adjacent receive frequency bands, while being thin and lightweight. Embodiments can be scaled to other frequency bands and phased array antenna applications, such as line-of-sight communication links, SIGINT arrays, radars, sensor arrays, and the like.

It will be appreciated that the configuration and dimension of the various components, including the linked-ring conducting resonator 102, the microstrip feed lines 104, and the conductive strips 202 and conductive vias 108 that comprise the Faraday cage 106, shown in the figures and described herein represent exemplary implementations of the of the antenna element 100, and that other implementations will become apparent to one skilled in the art upon reading this disclosure. In addition, various components may be added, removed, or substituted, and various techniques may be used in the manufacturing of the antenna element 100 beyond those described herein. It is intended that this application include all such implementations of the antenna element 100 manufactured by any process or method known in the art.

Figure 5:
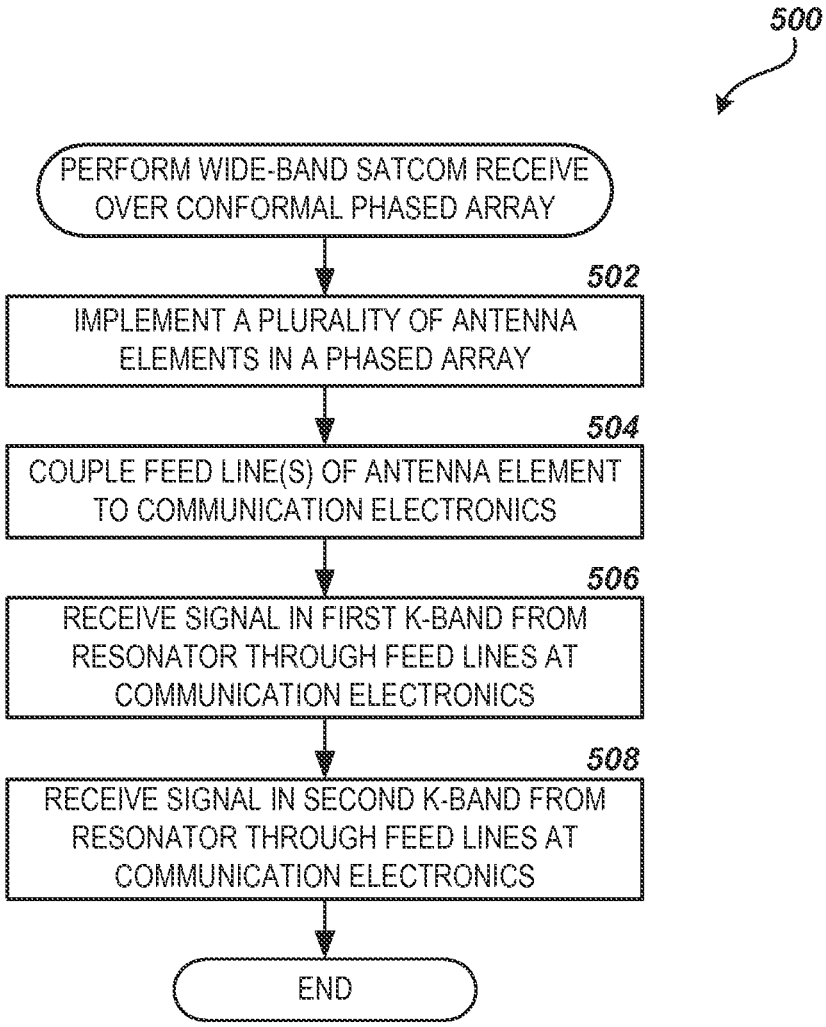
FIG. 5 is a flow diagram illustrating one method for performing dual-band SATCOM over a single, conformal phased array as provided in the embodiments described herein.

Turning now to FIG. 5, details will be provided regarding methods for performing dual-band SATCOM over a single, conformal phased array as provided in the embodiments described herein. It should be appreciated that the various logical operations, structural devices, acts, and components described herein may be implemented in special purpose electronics and electrical circuitry, in software or firmware of general-purpose computing devices, in special purpose digital logic, and any combination thereof. It should also be appreciated that more or fewer operations may be performed than shown in the figures and described herein. These operations may also be performed in parallel, or in a different order than those described herein.

FIG. 5 shows a routine 500 for performing wide-band SATCOM receive over a single, conformal phased array, according to one embodiment. The routine 500 begins at operation 502, where a conformal phased array is implemented including a number of antenna elements, at least one of which comprises an antenna element 100 shown in FIG. 1 and described above. As described above, each antenna element 100 in the array may include a linked-ring conductive resonator 102, one or more feed lines 104, and a surrounding Faraday cage 106, all implemented in a multi-layer circuit board. The conductive strips 202 and conductive vias 108 of the Faraday cage 106 may be electrically coupled to the ground plane 110 and arranged in a hexagonal shape surrounding the conductive resonator 102 and the feed lines 104, as shown in FIGS. 1, 3, and 4 above, so as to form an electrically conductive cage operable to isolate/shield the conductive resonator 102 and feed lines 104 of the antenna element 100 from bottom and side external electrical fields, such as those generated by neighboring antenna elements in the array. It will be appreciated that the conductive strips and conductive vias 108 may be arranged in any other polygonal shape that facilitates the implementation of the antenna element 100 in the array. In addition, the conductive strips 202 and conductive vias 108 comprising the Faraday cage 106 of one antenna element 100 may be shared with its neighboring antenna elements in the phased array, as further shown in FIG. 1.

From operation 502, the routine 500 proceeds to operation 504, where the feed lines 104 of the antenna element 100 are electrically coupled to communication electronics that provide independent signaling to and/or from the antenna element 100. As described above, the communication electronics may comprise special purpose electrical circuitry, software or firmware of general-purpose computing devices, any combination of these, and the like. In addition, the communication electronics may be partially or completely implemented on the multi-layer circuit board containing the antenna elements 100 of the phased array.

The routine 500 proceeds from operation 504 to operation 506, where the communication electronics detects a signal from one or more of the feed lines 104 coupled to the conductive resonator 102 to receive a signal in a first K-band. For example, the communication electronics may utilize the antenna element 100 to receive a signal in the 17.7-20.2 GHz commercial SATCOM receive K-band. According to one embodiment, the communication electronics may utilize two feed lines 104A and 104B implemented at substantially right angles to each other in the antenna element 100 to selectively receive a right-hand circular polarized or left-hand circular polarized signal (or dual orthogonal linear polarizations for other applications) through the conductive resonator 102.

From operation 506, the routine 500 proceeds to operation 508, where the communication electronics detects a signal from one or more of the feed lines 104 coupled to the conductive resonator 102 to receive a signal in a second K-band. For example, the communication electronics may utilize the antenna element 100 to receive a signal in the adjacent 20.2-21.2 GHz military SATCOM receive K-band. From operation 508, the routine 500 ends.

Based on the foregoing, it should be appreciated that technologies for a wide-band, linked-ring antenna element for phased arrays are provided herein. The subject matter described above is provided by way of illustration only and should not be construed as limiting. Various modifications and changes may be made to the subject matter described herein without following the example embodiments and applications illustrated and described, and without departing from the true spirit and scope of the present invention, which is set forth in the following claims.

What is claimed is:

1. An antenna element comprising:

a multi-layer circuit board;

a linked-ring conductive resonator located on a top layer of the multi-layer circuit board and comprising a plurality of ring elements connected by one or more tuning tabs;

a first feed line and a second feed line located on a middle layer of the multi-layer circuit board and capacitively coupled to the linked-ring conductive resonator;

an electromagnetically-shielding ground plane located on a bottom layer of the multi-layer circuit board; and a Faraday cage surrounding the linked-ring conductive resonator, the first feed line, and the second feed line and conductively coupled to the electromagnetically-shielding ground plane.

2. The antenna element of claim 1, wherein the linked-ring conductive resonator comprises an inner ring element and an outer ring element connected by four tuning tabs.

3. The antenna element of claim 1, wherein the first feed line is oriented at substantially 90 degrees with respect to the second feed line such that the antenna element may receive both right-hand circular polarized and left-hand circular polarized signals.

4. The antenna element of claim 1, wherein the Faraday cage comprises a conductive strip located on each layer of the multi-layer circuit board above the bottom layer and a plurality of conductive vias connecting the conductive strips to the electromagnetically-shielding ground plane.

5. The antenna element of claim 1, wherein each layer of the multi-layer circuit board is separated by a low-loss low-dielectric-constant material.

6. The antenna element of claim 1, wherein the antenna element is configured to be constructed with a plurality of antenna elements to form a phased array antenna.

7. A system for communicating on at least two adjacent satellite communication bands, the system comprising:

a plurality of antenna elements configured in a phased array, at least one of the plurality of antenna elements comprising a linked-ring conductive resonator having an inner ring element and an outer ring element connected by four tuning tabs, a first feed line and a second feed line capacitively coupled to the linked-ring conductive resonator, and a Faraday cage operable to shield the conductive resonator, the first feed line, and the second feed line; and communication electronics electrically coupled to the first feed line and the second feed line and configured to provide independent signaling to the at least one of the plurality of antenna elements.

8. The system of claim 7, wherein the first feed line and the second feed line are further operative to drive the linked-ring conductive resonator.

9. The system of claim 7, wherein the first feed line is oriented at substantially 90 degrees with respect to the second feed line.

10. The system of claim 7, wherein the Faraday cage comprises an electromagnetically-shielding ground plane coupled to a plurality of conductive strips by at least one conductive via.

11. An antenna element comprising:

a plurality of layers, each of the plurality of layers separated by a low-loss low-dielectric-constant material;

a linked-ring conductive resonator comprising a plurality of ring elements connected by one or more tuning tabs;

a feed line electromagnetically coupled to the conductive resonator; and a Faraday cage operable to shield the conductive resonator and the feed line, the linked-ring conductive resonator, the feed line, and the Faraday cage positioned among the plurality of layers.

12. The antenna element of claim 11, wherein the linked-ring conductive resonator comprises an inner ring element and an outer ring element connected by four tuning tabs.

13. The antenna element of claim 11, wherein the feed line is operable to drive the linked-ring conductive resonator.

14. The antenna element of claim 11, wherein the feed line is operable to receive a signal from the linked-ring conductive resonator.

15. The antenna element of claim 11, further comprising a first feed line and a second feed line, wherein the first feed line is oriented at substantially 90 degrees with respect to the second feed line.

16. The antenna element of claim 15, wherein the first feed line and the second feed line are located beneath the linked-ring conductive resonator in the antenna element and are capacitively coupled to the linked-ring conductive resonator.

17. The antenna element of claim 11, wherein the Faraday cage comprises an electromagnetically-shielding ground plane coupled to a plurality of conductive strips by at least one conductive via.

18. The antenna element of claim 17, wherein the linked-ring conductive resonator is located on a top layer, the feed line is located on a middle layer below the linked-ring conductive resonator, and the electromagnetically-shielding ground plane is located on a bottom layer, and wherein one of the plurality of conductive strips is located on each of the plurality of layers above the bottom layer.

19. The antenna element of claim 11, wherein the antenna element is configured to be constructed with a plurality of the antenna elements to form a phased array antenna.

20. A method for performing wide-band satellite communications ("SATCOM") over a conformal phased array, the method comprising:

implementing a phased array of a plurality of antenna elements, at least one of the antenna elements comprising a linked-ring conductive resonator comprising a plurality of ring elements connected by one or more tuning tabs, a feed line electromagnetically coupled to the conductive resonator, and a Faraday cage operable to shield the conductive resonator and the feed line from electrical fields of neighboring antenna elements in the phased array;

coupling the feed line of the at least one antenna element to communication electronics;

utilizing the communication electronics to drive the linked-ring resonator to receive a signal in a first SATCOM receive band; and utilizing the communication electronics to drive the linked-ring resonator to receive a signal in a second SATCOM receive band.

21. The method of claim 20, further comprising:

receiving a signal in a SATCOM band at the communication electronics through the conductive resonator and feed line of the at least one antenna element.

22. The method of claim 20, wherein the conductive resonator comprises an inner ring element and an outer ring element connected by four tuning tabs.

23. The method of claim 20, wherein a first feed line is oriented at substantially 90 degrees with respect to a second feed line in at least one antenna element such that the communication electronics may selectively receive both right-hand circular polarized and left-hand circular polarized signals.

24. The method of claim 20, wherein the Faraday cage comprises a hexagonal shape such that conductive strips and conductive vias of the Faraday cage are shared with the neighboring antenna elements in the phased array.

* * * * *